US008565632B2

(12) United States Patent
Kato et al.

(10) Patent No.: US 8,565,632 B2
(45) Date of Patent: Oct. 22, 2013

(54) IMAGE FORMING APPARATUS FOR CONTROLLING A TEMPERATURE OF A FIXING DEVICE THEREIN

(75) Inventors: Masahito Kato, Suntou-gun (JP); Norihito Naito, Numazu (JP); Tomonori Matsunaga, Suntou-gun (JP); Takahiro Ikeda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 258 days.

(21) Appl. No.: 13/035,452

(22) Filed: Feb. 25, 2011

(65) Prior Publication Data

US 2011/0217059 A1 Sep. 8, 2011

(30) Foreign Application Priority Data

Mar. 2, 2010 (JP) ..... 2010-045534
Feb. 22, 2011 (JP) ..... 2011-035797

(51) Int. Cl.
*G03G 15/20* (2006.01)

(52) U.S. Cl.
USPC ..... 399/69; 399/43

(58) Field of Classification Search
USPC ..... 399/43, 69
See application file for complete search history.

(56) References Cited

U.S. PATENT DOCUMENTS 5,481,346 A 1/1996 Ohzeki et al.
5,742,870 A * 4/1998 Hwang ..... 399/69
5,862,435 A * 1/1999 Suzumi et al. ..... 399/68
6,819,881 B2 11/2004 Kurita et al.
6,917,772 B2 7/2005 Hoshika
6,999,692 B2 * 2/2006 Shimura et al. ..... 399/69
2004/0109702 A1 6/2004 Shimura et al.

FOREIGN PATENT DOCUMENTS

CN 1477453 A 2/2004
JP 7160109 A 6/1995
JP 10-207266 A 8/1998
JP 2003307994 A 10/2003

OTHER PUBLICATIONS

Notification of First Office Action in CN Patent Appln. No. 201110049919.6 dated Apr. 27, 2013, State Intellectual Property Office of the People's Republic of China.

* cited by examiner

*Primary Examiner* — David Gray
*Assistant Examiner* — G. M. Hyder
(74) *Attorney, Agent, or Firm* — Fitzpatrick, Cella, Harper & Scinto

(57) ABSTRACT

An image forming apparatus includes an image bearing member for bearing a developer image; a developing device including a developer carrying member for forming the developer image on the image bearing member; a fixing device for fixing the developer image on a sheet material, on which the developer image has been transferred, by heating the sheet material; a memory medium for storing an operation hysteresis value, of the developing device, which varies depending on a state of an operation of the developing device from start of the operation; and a controller for controlling a temperature of the fixing device. The controller controls, when the operation hysteresis value stored in the memory medium reaches a preset threshold, the temperature of the fixing device so as to be lower than that before the operation hysteresis value reaches the preset threshold.

16 Claims, 5 Drawing Sheets

( a )

( b )

IMAGE FORMING APPARATUS FOR CONTROLLING A TEMPERATURE OF A FIXING DEVICE THEREIN

FIELD OF THE INVENTION AND RELATED ART

The present invention relates to an image forming apparatus.

As the image forming apparatus, there is an image forming apparatus of, e.g., an electrophotographic type. In the image forming apparatus of the electrophotographic type, a developing device for developing an electrostatic latent image into a developer image by supplying a developer to the electrostatic latent image formed on a surface of an image bearing member by scanning exposure is provided. The developing device includes a developer carrying member for carrying the developer, a developer container for controlling the developer, and the like and is constituted so that the developer carried on the surface of the developer carrying member is supplied electrostatically to the surface of the image bearing member. Incidentally, in recent years, the developing device is integrally assembled into a process cartridge together with the image bearing member and another process means (a charging member or the like) in many cases. Thus, a plurality of members are integrally assembled into the process cartridge, and the process cartridge is made detachably mountable to an image forming apparatus main assembly, so that it is possible to easily effect supply of the developer and other maintenance operations.

Further, in the image forming apparatus, a fixing device for fixing the developer image, which has been transferred from the image bearing member onto a sheet material, on the sheet material is provided. The fixing device includes a rotatable fixing member in which a heat source is provided, and includes a pressing member for press-contacting the rotatable fixing member to form a nip. According to such a constitution, by passing the sheet material through the nip, it becomes possible to heat and press the developer image on the sheet material, thereby to fix the developer image on the sheet material.

However, the above-described conventional image forming apparatus involves the following problems.

When an amount of operation or use (operation amount) of the process cartridge is increased, the developer in a sufficient amount is less liable to be supplied from the developing device, with the result that the amount of the developer supplied onto the sheet material can be decreased. This phenomenon is hereinafter referred to as a "lowering developing property". When the lower in developing property expensively proceeds particularly with respect to a solid image, an image density becomes low. There are various factors in the lowering in developing property but, e.g., a deterioration of the developer and smoothing of the developer carrying member surface may be cited. A relationship among the deterioration of the developer, the smoothing of the developer carrying member surface and the lowering in developing property will be described.

<Deterioration of developer>

In the developing device, a developing blade for regulating a layer thickness of the developer carried on the developer carrying member surface and for triboelectrically charging the developer is provided. For this reason, when the operation amount of the process cartridge is increased, the developer in the developing device is repetitively subjected to rubbing, stirring and circulation by this developing blade, so that the developer is deteriorated. Incidentally, herein, the deterioration of the developer refers to abrasion (wearing) and deformation of a toner resin material, embedding of an external additive in the toner resin material, and the like. In a high temperature and high humidity environment, a degree of the deterioration is more noticeable. When the developer is deteriorated in such a manner, compared with a fresh developer, behavior such as a charging property or flowability is changed, thus causing the lowering in developing property.

<Smoothing of Developer Carrying Member Surface>

With respected to the surface of the developer carrying member, a certain surface roughness is set in order to a larger amount of the developer with reliability. However, when the operation amount of the process cartridge is increased, due to the abrasion of the developing blade and other factors, the surface roughness of the developer carrying member is lowered, i.e., the surface of the developer carrying member is smoothed (flattened). Thus, when the developer carrying member surface is smoothed, it is difficult to carry a sufficient amount of the developer on the developer carrying member surface, so that the lowering in developing property is invited.

As described above, when the operation amount of the process cartridge is increased, the "lowering in developing property" progresses. In response, techniques for solving a problem of a decrease in image density generated by the progress of the "lowering in developing property" described above have been disclosed in Japanese Laid-Open Patent Application (JP-A) Hei 7-160109, JP-A 2003-307994 and U.S. Pat. No. 6,917,772. However, even in the case where these conventional techniques are used, when the operation amount of the process cartridge is increased, the "lowering in developing property" occurs and then an image decreased in density is formed in some cases. Particularly, in the case of a constitution in which the developer on the developer carrying member is formed in a thin layer and has high triboelectric charge and in which a sharp image is formed by bringing a developing efficiency of a solid image near to 100%, the techniques disclosed in JP-A Hei 7-160109, JP-A 2003-307994 and U.S. Pat. No. 6,917,772 are inadequate.

Further, in the conventional constitutions, in the case where, e.g., the amount of the developer on the sheet material is decreased by the lowering in developing property but the decrease in image density does not occur in a state before a fixing process, the fixing process is performed to cause the image density decrease in some instances. Further, in the case where the lowering developing property further progresses and the image density decrease occurs before the fixing process, the fixing process is performed and then the image density decrease further progresses in some instances.

A phenomenon of the image density decrease occurring during the fixation is caused by new formation of a (sheet material) texture (developer-less portion) on the sheet material after the fixation when the sheet material is passed through the fixing device in a state in which the amount of the developer to be transferred onto the sheet material is small. Hereinafter, this phenomenon is referred to as a "texture exposure due to fixation". With reference to (a) and (b) of FIG. 5, a mechanism of the occurrence of this phenomenon will be described.

Part (a) of FIG. 5 is a schematic view showing a state when a sheet material P, on which a solid image has been transferred, causing no "lowering developing property" is heated and pressed by a fixing device. Incidentally, a projected (convex) portion formed on the sheet material P in the figure shows a portion at which fiber of the sheet material P is protruded. In this case, it is understood that toner T (developer) is present sufficiently on the sheet material P and therefore the toner is melted and thus the developer image is fixed on the sheet material P in a state in which particles of the toner T are spread all over the sheet material P. That is, the developer image heated and pressed in the nip of the fixing device, whereby it becomes possible to obtain a good image without causing image defect of "texture exposure due to fixation" on the sheet material P after the fixation.

Part (b) of FIG. 5 is a schematic view showing a state when the sheet material P, on which the image has been transferred, causing the "lowering in developing property" is heated and pressed by the fixing device. In this case, a total number of the toner particles placed on the sheet material P is small and therefore when compared with the case of the solid image, an amount of heat applied per (one) toner particle is increased. For that reason, particularly at the highest point of the projected portion, melt viscosity lowering of the toner T is liable to occur. Then, with the highest point of the projected portion as a starting point, the particles of the toner T are slightly moved on the sheet material P in directions indicated by arrows A, so that such a phenomenon that the toner T concentrates at the projected portion and on the other hand, the amount of the toner T is decreased, i.e., the texture of the sheet material P is exposed at a periphery of the projected portion (regions B in the figure) occurs. Further, this phenomenon constitutes a factor of the "texture exposure due to fixation". Incidentally, in this case, attention is paid to unevenness (projection and recess) of the sheet material P at the protruded printer of the fiber but the "texture exposure due to fixation" is also caused by slight non-uniformity of a heat conductivity characteristic of the sheet material P or the rotatable member. Further, in some cases, the "texture exposure due to fixation" is caused also by slight non-uniformity of the toner amount on the sheet material P or non-uniformity of the amount of heat per unit toner amount.

SUMMARY OF THE INVENTION

A principal object of the present invention is to provide an image forming apparatus in which image density lowering on an image after fixation is less liable to occur even in the case where an amount of a developer for a solid image to be transferred onto a sheet material is decreased with operation (use) of a process cartridge.

According to an aspect of the present invention is to provide an image forming apparatus comprising: an image bearing member for bearing a developer image; a developing device including a developer carrying member for forming the developer image on the image bearing member; a fixing device for fixing the developer image on a sheet material, on which the developer image has been transferred, by heating the sheet material; a memory medium for storing an operation history value, of the developing device, which varies depending on a state of an operation of the developing device from start of the operation; and a controller for controlling a temperature of the fixing device, wherein the controller controls, when the operation history value stored in the memory medium reaches a preset threshold, the temperature of the fixing device so as to be lower than that before the operation history value reaches the preset threshold.

These and other objects, features and advantages of the present invention will become more apparent upon a consideration of the following description of the preferred embodiments of the present invention taken in conjunction with the accompanying drawings.

Figure 2:
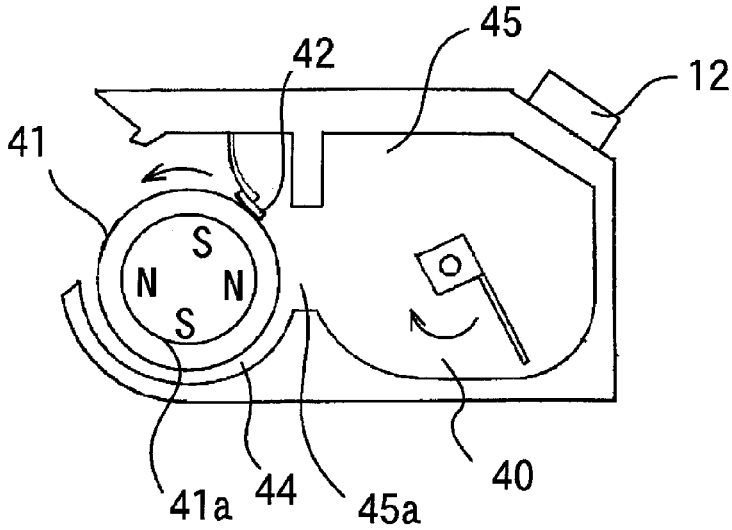
Figure 2:
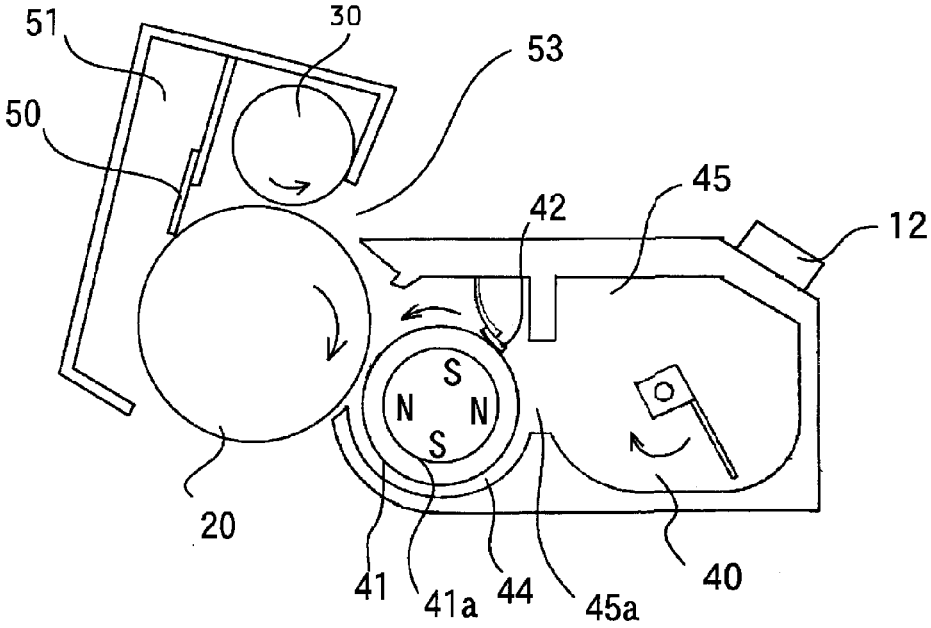

Part (a) of FIG. 2 is a schematic structural view of a developing device in First Embodiment, and (b) of FIG. 2 is a schematic structural view of a process cartridge in First Embodiment.

Figure 3:
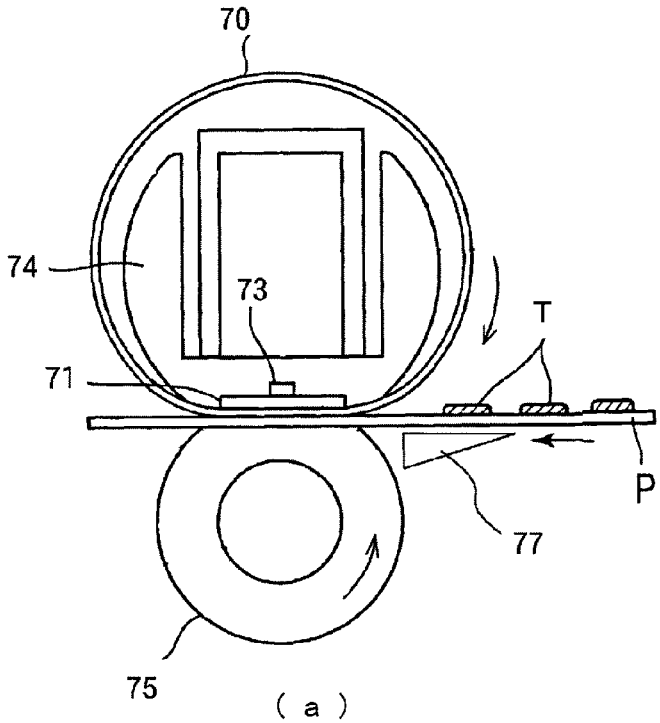
Figure 3:
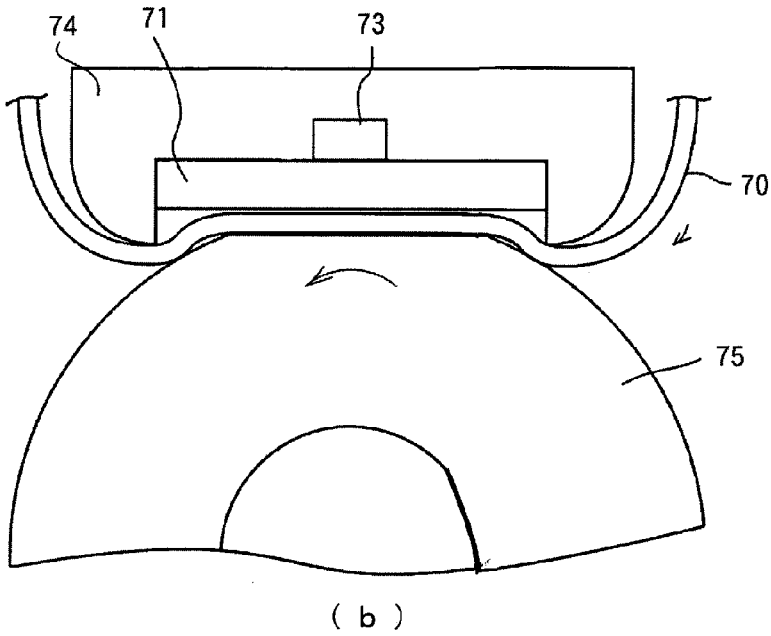

Part (a) of FIG. 3 is a schematic structural view of a fixing device in First Embodiment, and (b) of FIG. 3 is an enlarged view of a fixing nip in First Embodiment.

Figure 4:
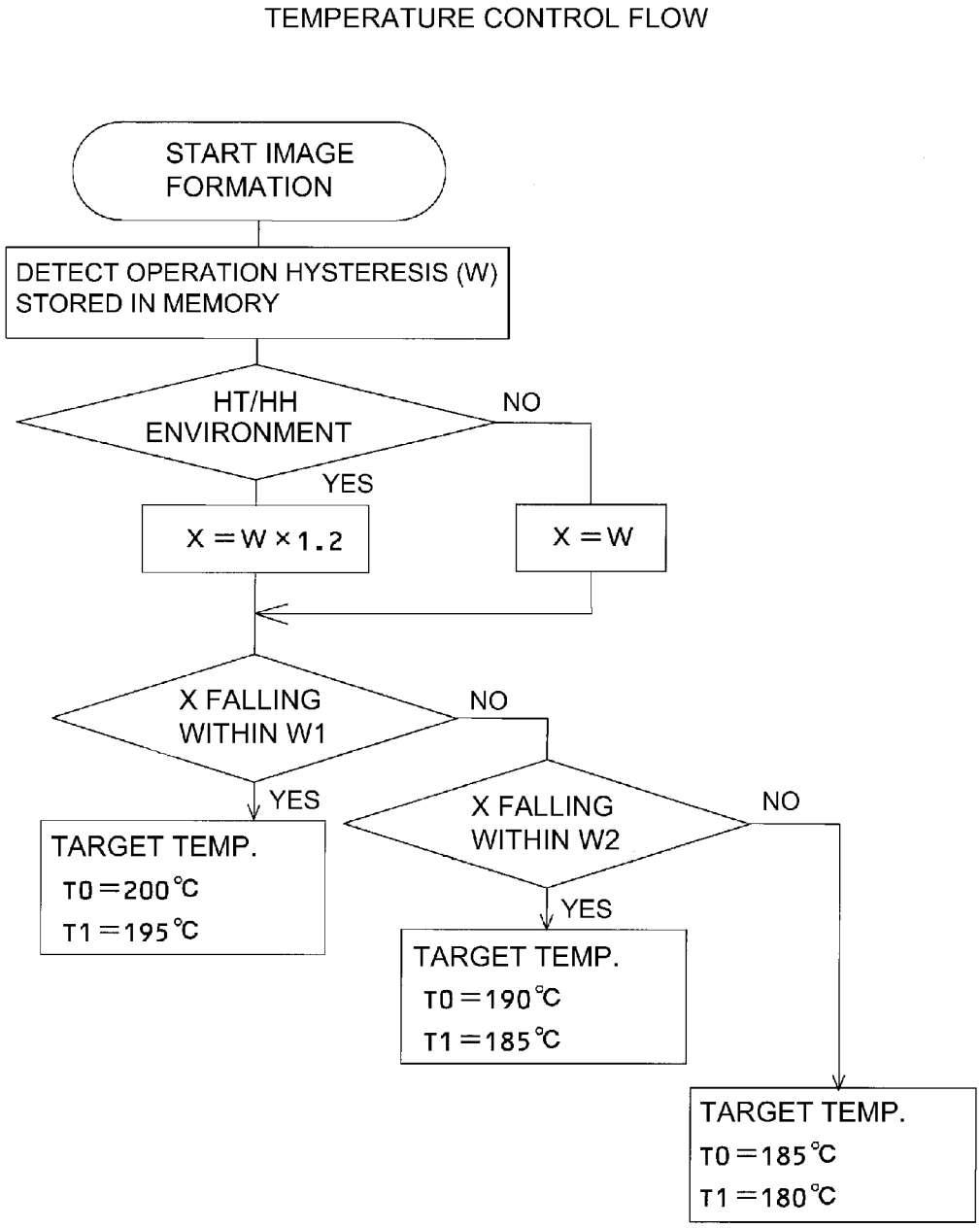

FIG. 4 is a flow chart showing temperature control flow of the fixing device in First Embodiment.

Figure 5:
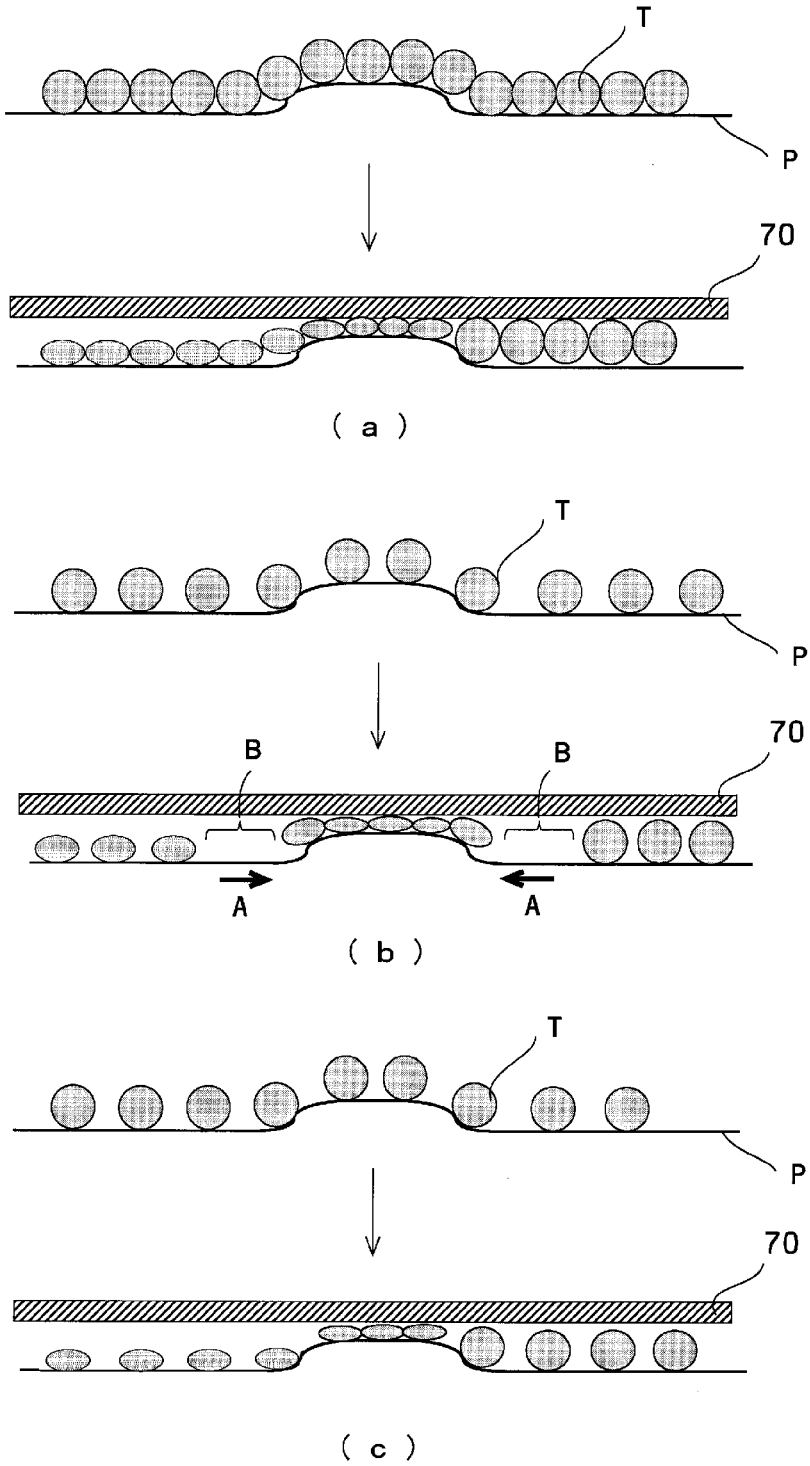

Parts (a) and (b) of FIG. 5 are schematic views for illustrating a mechanism of an occurrence of image defect in a fixing device, and (c) of FIG. 5 is a schematic view for illustrating a mechanism of suppression of the image defect in First Embodiment.

DESCRIPTION OF THE PREFERRED EMBODIMENTS

Hereinbelow, embodiments for carrying out the present invention will be specifically described with reference to the drawings. However, with respect to dimensions, materials, shapes, relative arrangements and the like of constituent elements described in the following embodiments, the scope of the present invention is not limited thereto unless otherwise specified.

[Embodiment 1]

(1: Image Forming Apparatus)

Figure 1:
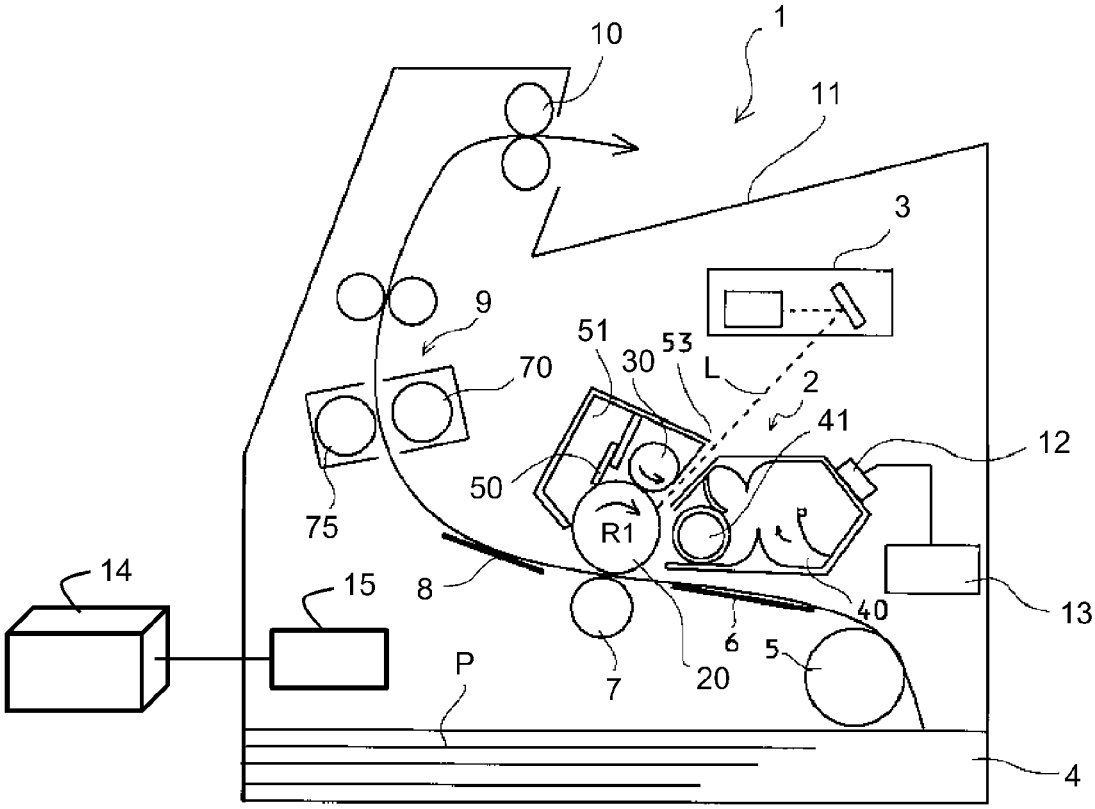
FIG. 1 is a schematic structural view of an image forming apparatus according to First Embodiment.

With reference to FIG. 1, the image forming apparatus according to this embodiment of the present invention will be described. The image forming apparatus in this embodiment is a laser beam printer of an electrophotographic type and a process cartridge mounting and demounting type.

To a printer 1 in this embodiment, an external host device 14 such as a personal computer or an image reading device (image scanner) is connectable. By such a constitution, image information is inputted from the external host device 14 into a controller (control portion) 15. On the basis of the inputted image information, the controller 15 drive-controls respective members and devices of the image forming apparatus.

The printer 1 includes a process cartridge 2 detachably mountable to a printer main assembly (main assembly of the image forming apparatus). Incidentally, herein, the "printer main assembly (apparatus main assembly)" refers to a constitution in which the process cartridge 2 is removed from the printer 1.

The printer 1 includes a drum type electrophotographic photosensitive member 20 as an image bearing member (hereinafter referred to as a photosensitive drum 20). The photosensitive drum 20 is rotationally driven in the clockwise direction indicated by an arrow R1 at a peripheral speed (process speed) of 147.6 mm/sec on the basis of a print start signal. Further, to the photosensitive drum 20, a charging roller 30 (charging device), to which a charging voltage is to be applied, is contacted and is rotationally driven by the photosensitive drum 20. As a result, an outer peripheral surface of the photosensitive drum 20 is uniformly charged to a predetermined polarity and a predetermined potential by the charging device. Incidentally, in this embodiment, by the voltage applied to the charging roller 30, the surface of the photosensitive drum 20 is charged to a predetermined negative potential.

The thus uniformly charged surface of the photosensitive drum 20 is subjected to laser scanning exposure depending on image information by a laser scanner unit 3 (exposure device). Laser light L outputted from the laser scanner unit 3 enters the process cartridge 2 from an exposure window portion 53 at an upper surface of the control 2, so that the surface of the photosensitive drum 2 is exposed to the laser light L. The laser scanner unit 3 outputs the laser light which has been modulated (ON/OFF-modulated) correspondingly to a time-serial electric digital pixel (picture) signal of the image information inputted from the host device to the controller, so that the surface of the photosensitive drum 20 is subjected to scanning exposure. When the photosensitive drum 20 is irradiated with the laser light L, a potential of the surface of the photosensitive drum 20 at an irradiation portion (light portion) is decayed, so that an electrostatic latent image corresponding to the image information is formed on the photosensitive drum 20.

The electrostatic latent image is developed into a developer image (toner image) with a developer (toner) carried on a developing sleeve 41 (developer carrying member) provided in the developing device. In this embodiment, a jumping development system using a magnetic one-component toner as the developer and a reverse development type in which the light portion of the electrostatic latent image is developed with negative toner are employed. Incidentally, in this embodiment, as the developer carrying member, the developing sleeve 41 is used but the developer carrying member is not limited thereto and may be, e.g., a developing roller.

Further, the printer 1 includes a sheet tray portion 4 (feeding portion) where sheets of a sheet material P are stacked. When a signal for image formation start is inputted, with predetermined timing, a pick-up roller 5 of the sheet tray portion 4 is driven and then the sheets of the sheet material P stacked in the sheet tray portion 4 are separated and fed one by one. The sheet material P passes through a conveying path including feeding rollers and conveying rollers (not shown) and is introduced, with predetermined timing, into a transfer nip which is a contact portion between the photosensitive drum 20 and a transfer roller 7 (transfer member) via a transfer guide 6. Then, in a process in which the sheet material P is nip-conveyed in the transfer nip, a transfer voltage of an opposite polarity to a charge polarity of the toner is applied to the transfer roller 7, so that the transfer images on the surface of the photosensitive drum 20 are successively transferred electrostatically onto the sheet material P.

The sheet material P coming out of the transfer nip is separated from the surface of the photosensitive drum 20 and is introduced along a conveying guide 8 into a fixing nip which is a contact portion between a fixing sleeve 70 and a pressing roller 75 of a fixing device 9. Incidentally, the surface of the photosensitive drum 20 after the separation of the sheet material P is subjected to removal of a residual contaminant such as transfer residual toner by a cleaning blade 50 provided in a cleaning device 51, thus being cleaned. The collected toner is repetitively subjected to image formation starting from the charging step again. The sheet material P introduced into the fixing device 9 is subjected to a fixing process in which the toner images are heated and pressed during the nip-conveyance in the fixing nip. The sheet material P coming out of the fixing device 9 passes through an upper conveying path including conveying rollers and then is discharged on a discharge tray 11 by a discharging roller 10.

(2: Developing Device)

With reference to (a) of FIG. 2, a schematic structure of a developing device 40 in this embodiment will be described. The developing device 40 includes a toner chamber 45 (toner accommodating chamber) for accommodating toner T and a developing chamber 44 including the developing sleeve 41. The toner T is fed, by toner stirring, into the developing chamber 44 through a toner supply opening 45*a* formed between the toner chamber 45 and the developing chamber 44. The toner T fed into the developing chamber 44 is attracted to the developing sleeve 41 by the action of a magnet 41*a* contained in the developing sleeve 41 and is fed toward a developing blade 42 by the rotation of the developing sleeve 41. Then the toner T is triboelectrically charged and subjected to layer thickness regulation by the developing blade 42, thus being fed toward the photosensitive drum 20. Incidentally, in this embodiment, as the developing sleeve 41, a sleeve prepared by roughening the surface of an aluminum bare tube by sandblasting and then by coating the bare tube with a phenolic resin material liquid, in which carbon black fine particles and graphite fine particles are dispersed, to provide a surface roughness Ra of 1.0 μm is used. By using such a developing sleeve 41, a charge-up phenomenon of the toner T is suppressed. Further, the developing blade 42 is constituted by bonding an urethane rubber to a supporting metal plate and is contacted to the surface of the developing sleeve 41 in a direction (counter direction), in which the developing blade 42 abuts against the rotation of the developing sleeve 41, at a contact pressure of 20 g/cm$^2$ with respect to the developing sleeve 41.

In this embodiment, a developing voltage in the form of a DC voltage (Vdc=−400 V) biased with an AC voltage (peak-to-peak voltage=1500 Vpp, frequency f=2400 Hz) is applied to the developing sleeve 41, and the photosensitive drum 20 is grounded. By such a constitution, an electric field is generated in an opposing region between the photosensitive drum 20 and the developing sleeve 41 and therefore the electrostatic latent image formed on the surface of the photosensitive drum 20 can be electrostatically developed with the charged toner T.

(3: Process Cartridge)

(3-1: Structure of Process Cartridge)

With reference to (b) of FIG. 2, a schematic structure of the process cartridge 2 will be described. The process cartridge 2 is constituted by integrally assembling four types of process devices consisting of the photosensitive drum 20, the charging roller 30, the developing device 40 and the cleaning device 51 into a cartridge, which is detachably mountable to the printer main assembly.

When the process cartridge 2 is mounted, an openable portion (not shown) of the printer main assembly is opened to expose the inside of the printer main assembly and then the process cartridge 2 is inserted into a predetermined mounting position along a guide portion (not shown). In a state in which the process cartridge 2 is mounted in the printer main assembly, the exposure device 3 is located above the process cartridge 2 and the sheet tray portion 4 is located below the process cartridge 2. Further, when the process cartridge 2 is demounted, an operation opposite from that during the mounting may only be required to be performed.

The photosensitive drum 20 and the charging roller 30 are mounted to a frame of the cleaning device 51. The cleaning device 51 includes the cleaning blade 50, and a cleaning unit is constituted by the photosensitive drum 20, the charging roller 30 and the cleaning device 51. The developing device 40 is constituted as a developing unit separately from the cleaning unit in a state where the developing chamber 44 in which the developing sleeve 41 is rotatably disposed at the opening and the toner chamber in which the toner T is accommodated are connected.

Further, on the frame surface of the process cartridge 2, a memory 12 as a memory (storing) medium is provided, and on the printer main assembly side, a communicating portion for performing signal transmission with the memory 12. That is, according to this embodiment, information can be written into and read from the memory by the controller, provided in the printer 1, via the communicating portion 13.

In this embodiment, an "operation history value" which varies depending on an operation (use) of the developing device 40 from initial operation (use) is written and stored in the memory 12 as needed. Here, the "operation history value" of the developing device 40 is, e.g., an integrated value, from initial operation (at the time of start of use), a rotation time or the number of rotations of each of the photosensitive drum 20, the charging roller 30, the developing sleeve 41 and the like.

Further, the operation history value may also be a bias application time to the charging roller 30, the developing sleeve 41 and the like, a remaining toner amount, a print number, the number of dots of the image formed on the photosensitive drum 20, an integrated value of laser emission time during exposure of the photosensitive drum 20, or a film thickness of the photosensitive drum 20. Further, the operation history value may also be resistance values of respective members of the printer 1 varying depending on a temperature and humidity environment in which the process cartridge 2 is operated and an ambient temperature and humidity or may be a remaining toner amount (remaining developer amount) accommodated in the developing device 40 or the like.

Further, these parameters may be combined or can also be combined after a specific parameter is weighted. That is, the type of the "operation history value" is not particularly limited so long as the parameter can be read by the controller via the communication portion 13 and varies depending on an operation (use) state of the developing device from the initial operation.

Further, in this embodiment, the developing device 40 is held by the process cartridge 2 but the present invention relates to a phenomenon which occurs by a change in developing property with a change in operation history value of the developing device 40. Therefore, the present invention is also applicable to the image forming apparatus of the type other than the process cartridge type. For example, it is possible to achieve an effect similar to that of this embodiment so long as a constitution in which the developing property is changed with a change in operation history value of the developing device 40 even in the toner supply constitution is employed.

(3-2: Operation History of Developing Device)

In the above, the point that the various parameters can be used as the "operation history value" of the developing device 40 stored in the memory 12 was described. In this embodiment, as the "operation history value" which is an index of the operation amount of the developing device 40, the number of sheets subjected to image formation on the sheet material (the number of sheets of the sheet material having passed through the fixing nip) is counted. That is, this embodiment is characterized by a point that the controller on the printer main assembly side judges the operation amount of the developing device 40 and effects temperature control of the fixing device 9 when the operation amount reaches a preset threshold.

(4: Fixing Device)

(4-1: Structure of Fixing Device)

Referring to FIG. 3, the schematic structure of the fixing device 9 in this embodiment will be described. Part (a) of FIG. 3 shows the schematic structure of the fixing device 9 in this embodiment, and (b) of FIG. 3 is an enlarged view of a fixing nip in the fixing device 9.

The fixing device 9 includes a fixing sleeve 70 which includes a heater 71 inside thereof and is rotatable in a direction indicated by an arrow, and includes an elastic pressing roller 75 (pressing member) for forming the fixing nip in press-contact with the fixing sleeve 70. A constitution in which the elastic pressing roller 75 is rotationally driven in a direction indicated by an arrow and thereby the fixing sleeve 70 is rotationally driven is employed. The heater 71 is prepared by forming a heat generating resistor on a ceramic substrate and is constituted so as to be heated by being energized from an unshown power source. Further, the heater 71 is held by a heater holder 74 so that the heater directly slides on an inner peripheral surface of the fixing sleeve 70.

Further, the fixing device 9 includes a thermistor 73 for detecting the temperature of the heater 71. The thermistor 73 is connected to the controller provided in the printer main assembly and is constituted so that the controller can control an amount of energization to the heater 71 on the basis of a detection temperature of the thermistor 73. Further, the thermistor 73 is disposed in a passing area of a sheet material having the narrowest width (with respect to a direction perpendicular to a conveyance direction) of the sheet materials which can pass through the fixing nip. Thus, the fixing device 9 in this embodiment is constituted so that the fixing device 9 can be temperature-controlled by the controller.

When the temperature control is effected, first, the power of the printer main assembly is turned on to start the energization to the heater 71, so that the surface temperature of the heater 71 is increased. In this case, the temperature control is effected so that the temperature of the heater is a print-ready target temperature T0. Thereafter, when the image formation start signal is inputted, the temperature control is effected so that the temperature of the heater 71 is a print target temperature T1. Further, it is also possible to effect the temperature control by appropriately changing the target temperatures T0 and T1 (T0: target temperature before image formation, T1: target temperature during image formation) depending on an operation environment of the printer 1, the type of the sheet material P, a degree of warming of the fixing device 9 and the like. Here, T0 refers to the target temperature in a preparatory operation (pre-rotation) before the image formation, and the temperature of the fixing film during the image formation can be appropriately controlled by warming the fixing sleeve in advance, which is left standing in, e.g., a low-temperature environment. Incidentally, in the pre-rotation, raising of the fixing device and an operation for rotating the developing sleeve are performed.

By such a constitution, the sheet material P on which an unfixed toner image is formed is guided by a fixing device entrance guide 77 to be conveyed into the fixing nip, where the unfixed toner image is heated and pressed and is fixed on the sheet material P as a permanent image. Then, the sheet material P having passed through the fixing nip is separated from the outer peripheral surface of the fixing sleeve 70 and then is discharged on the discharge tray 11. Incidentally, in this embodiment, a structure provided with the fixing sleeve is described but a structure provided with a fixing roller may also be used.

(4-2: Temperature Control of Fixing Device)

This embodiment is characterized in that a fixing condition depending on the lowering in developing property is set on the basis of the operation history value of the developing device 40. That is, on the basis of the number of rotations (=operation history value) of the developing sleeve 41 stored in the memory 12, the target temperatures T0 and T1 of the fixing device 9 are changed by the controller of the printer main assembly. More specifically, in the case where the amount of the toner transferred onto the sheet material P is decreased by the developing property lowering, in order to suppress the "texture exposure due to fixation", the fixing temperature depending on the amount of the decreased developer is set.

In this embodiment, when the number of rotations of the developing sleeve 41 is increased (when the operation history value is changed), the value is compared with a preset threshold and the temperature control is effected so that the temperature of the fixing device 9 is lowered when the value reaches the threshold. Here, with reference to (c) of FIG. 5, a mechanism of a decrease in degree of "texture exposure due to fixation" compared with the conventional case will be described in the case where such temperature control is effected. Part (c) of FIG. 5 is a schematic view showing a degree of the fixation of the toner image in the case where the temperature control in this embodiment is effected.

As shown in (c) of FIG. 5, in this embodiment, the amount of heat applied per one toner particle is decreased compared with the conventional case and therefore it becomes possible to suppress a lowering in melt viscosity of the toner in the neighborhood of the highest point of the projected portion in the figure showing the protruded portion of the fiber of the sheet material. As a result, movement of the toner in the directions indicated by the arrows A at a periphery of the projected portion can be suppressed. Thus, even in the case where the "lowering in developing property" is caused, it is possible to form a solid image of the toner uniformly coated on the sheet material P by lowering the fixing temperature to suppress the degree of the "texture exposure due to fixation".

Then, specific temperature control of the fixing device 9 in this embodiment will be described. First, the operation history value of the developing device 40 in this embodiment is defined by being divided into the following threshold values (ranges) W1 to W3. The number W of sheets subjected to passing when LTR paper as the sheet material is passed in a one sheet-intermittent manner is taken as the operation history value. That is, on the basis of the sheet passing number W which is which range of W1, W2 and W3, the temperature control of the fixing device 9 is effected.

W1: from initial operation (use) to 1500-th sheet (developing device before progress of deterioration)

W2: from 1501-st sheet to 2000-th sheet (developing device lowered in developing device by deterioration)

W3: 2001-st sheet and later (developing device further lowered in developing property by deterioration)

According to study by the present inventors, it was found that the developing property is lowered with an increasing sheet passing number W. Therefore, in this embodiment, the target temperature of the fixing device 9 was set in the following manner correspondingly to the thresholds W1 to W3 described above. That is, when the operation history value (the sheet passing number W in this embodiment) is increased and reaches the threshold, the temperature control is effected so that the temperature of the fixing device 9 is lowered.

W1: T0=200° C./T1=195° C.

W2: T0=190° C./T1=185° C.

W3: T0=185° C./T1=180° C.

Incidentally, in this embodiment, T0>T1 is satisfied but this is attributable to a necessary amount of heat is increased compared with that during the image formation since the fixing film is warmed again in some cases from an ambient temperature to the fixing temperature during the pre-rotation. Further, depending on a mounting environment or operation state of the image forming apparatus, the necessary amount of heat is further increased in some instances. For example, in the case of T0≤T1, in the low temperature environment, the amount of heat supplied during the pre-rotation becomes sufficient in some instances. Due to this, improper fixing can occur at a leading edge of the sheet material and therefore the condition: T0>T1 is employed.

Incidentally, in this embodiment, the target temperature of the fixing device 9 is changed with the lowering in developing property as the operation progresses. However, also in the case where the amount of the developer to be placed on the sheet material is intentionally decreased, when the target temperature of the fixing device 9 is changed as described above, it becomes possible to obtain a good image suppressed in the degree of the "texture exposure due to fixation". Further, a similar effect can be obtained also with respect to a fluctuation in developing property in the first half of the W value due to a rising phenomenon of an electric charge imparting property of the developing device.

Table 1 shown below includes density data of the slid image in the case where the target temperature control of the fixing device 9 in this embodiment is not effected and in the case where the target temperature control is effected. According to the density data in Table 1, in the case where the control in this embodiment is effected, even when the W value is increased, the solid image density is not lowered remarkably. That is, it is understood that the decrease in image density with the "texture exposure due to fixation" can be suppressed. Incidentally, verification made in this embodiment is a result of measurement of the solid image density by performing a one sheet-intermittent durability test using the image forming apparatus in this embodiment. Further, the image density is a result of measurement using a reflection density measuring device (densitometer "RD-918", mfd. by Macbeth Co.).

TABLE 1

| | | CONV.*3 | | EMB*4 | |
|---|---|---|---|---|---|
| HA*1 | OA*2 | T0/T1*5 | SID*6 | T0/T1 | SID |
| Large | W1 | 200/195 | 1.50 | 200/195 | 1.55 |
| Medium | W2 | 200/195 | 1.30 | 190/185 | 1.37 |
| Small | W3 | 200/195 | 1.20 | 185/180 | 1.30 |

*1"HA" represents the amount of heat per unit toner necessary for fixation.
*2"OA" represents the operation amount of the developing device.
*3"CONV." represents the conventional embodiment.
*4"EMB." represents this embodiment.
*5"T0/T1" represents the target temperatures T0 and T1 (° C.).
*6"SID" represents the solid image density.

Incidentally, in this embodiment, the temperature control is effected by comparing the "sheet passing number W of sheet material" with the respective thresholds but a similar effect can be obtained also by replacing the "sheet passing number W" with "the number of rotations of developing sleeve". For example, as the "operation history value" which is the index of the operation amount of the developing device 40, the number of rotations of the developing sleeve 41 may also be counted. Then, on the basis of the number of rotations of the developing sleeve 41 stored in the memory 12, the controller on the printer main assembly side judges the operation amount of the developing device 40 and effects the temperature control of the fixing device 9 when the operation amount reaches the preset threshold. Specifically, in the case where the number of rotations of the developing sleeve 41 reaches the threshold, the controller controls the temperature of the fixing device 9 so as to be lower than that before the number of rotations of the developing sleeve reaches the threshold. Further, it is also possible to employ not only the number of rotations of the developing sleeve but also other parameters such as the "remaining toner amount (remaining developer amount)" or to employ a combination of these parameters. For example, in the case where the "remaining toner amount" is counted, the remaining toner amount is decreased with the operation of the developing device 40, so that the temperature of the fixing device 9 may be controlled when the "remaining toner amount" is lower than a certain threshold.

As described above, according to this embodiment, even in the case where the amount of the developer transferred onto the sheet material is decreased with the operation of the process cartridge, it becomes possible to provide the image forming apparatus in which the lowering in density of the solid image is less liable to occur.

[Second Embodiment]

This embodiment is characterized in that a parameter obtained by weighting of the index indicating the operation environment in which the image formation was effected is used. Incidentally, the constitution of the image forming apparatus is identical to that in First Embodiment described above, thus being omitted from the description.

It has been understood that the deterioration of the developing device is accelerated particularly in a high temperature and high humidity environment. On the other hand, according to study by the present inventors, it has been understood that a speed of the deterioration is not largely affected by an operation environment in a low temperature and low humidity environment or in a normal temperature and normal humidity environment.

Therefore, in this embodiment, in the case where the high temperature and high humidity environment is detected by an unshown temperature and humidity sensor (environment detecting means), weighting (correction) of an environmental index $\alpha B(=1.2)$ made with respect to an actual sheet passing number W of the sheet material and a resultant value was used as an index X(=operation history value). That is, based on the detection result of the temperature and humidity sensor, in the case where the high temperature and high humidity environment is detected, the temperature control of the fixing device 9 is effected by comparing the index X defined by (the sheet passing number W of the sheet material)×1.2=X with the thresholds W1 to S3 used in First Embodiment. In other words, this can be said that "the operation history value is corrected to a value corresponding to the operation amount which is larger than the actual operation amount of the developing device 40". For example, even in the case where the actual sheet passing number W is 100 sheets, in the high temperature and high humidity environment, the sheet passing number W is corrected to 120 sheets, and the corrected value is stored as the operation history value and then is compared with the thresholds W1 to W3.

Incidentally, with respect to the "high temperature and high humidity environment" referred to in this embodiment, the temperature and the humidity are not particularly limited but refer to those at which the deterioration of the developing device is accelerated. When the values of the temperature and the humidity are compared with preset reference values and are higher than the reference values, the environment is judged as the "high temperature and high humidity environment".

W1: from initial operation to 1250-th sheet (developing device before progress of deterioration).

W2: from 1251-st sheet to 1666-th sheet (developing device lowered in developing device by deterioration)

W3: 1667-th sheet and later (developing device further lowered in developing property by deterioration)

On the basis of the thresholds W1 to W3, the target temperature of the fixing device 9 was controlled in the following manner.

W1: T0=200° C./T1=195° C.

W2: T0=190° C./T1=185° C.

W3: T0=185° C./T1=180° C.

FIG. 4 shows a control flow of the temperature control in this embodiment. In this embodiment, the temperature control is effected by comparing the "sheet passing number W of sheet material" with the respective thresholds but, similarly as in First Embodiment, a similar effect can be obtained also by replacing the "sheet passing number W" with "the number of rotations of developing sleeve". Further, it is also possible to employ not only the number of rotations of the developing sleeve but also other parameters such as print history and the "remaining toner amount (remaining developer amount)" obtained by a remaining amount detecting means or to employ a combination of these parameters.

As described above, according to this embodiment, even in the case where the amount of the developer transferred onto the sheet material is decreased with the operation of the process cartridge, it becomes possible to provide the image forming apparatus in which the lowering in density of the solid image is less liable to occur.

[Third Embodiment]

In Second Embodiment described above, the constitution in which the operation environment was measured by using the temperature and humidity sensor was described. This embodiment is characterized in that the operation environment (temperature, humidity) is determined on the basis of a resistance value of the transfer roller 7.

A technique using a control method of ATVC type for controlling a transfer voltage Vt to be applied to the transfer roller has been conventionally known. In this control method, a predetermined current I is applied during the image formation, and from a detected voltage value Vo at that time, a resistance R of the transfer roller is detected and then a transfer voltage Vt depending on the resistance R is determined. Therefore, in this embodiment, environment detection is effected by using the phenomenon that the resistance value R of the transfer roller is lowered in the high temperature and high humidity environment.

In this embodiment, the process speed was 147.6 mm/sec and as the transfer roller 7, one having the resistance value R of $2\times10^8\Omega$ to $2.5\times10^8\Omega$ in the normal temperature and normal humidity environment (temperature: 25.0° C./humidity: 60%) was used. A current I1 applied during the ATVC control was 6 μA. The resistance value of the transfer roller 7 varied depending on the environment and was $1.3\times10^8$ in the high temperature and high humidity environment (32.5° C./80%). That is, in this embodiment, it is possible to detect the high temperature and high humidity environment depending on the measured value of the detected voltage value $V_0$.

In this embodiment, $V_0$ is roughly as follows.

$V_0$ (normal temperature and normal humidity)=1.2 KV $V_0$ (high temperature and high humidity)=0.78 kV Therefore, in this embodiment, the threshold for detecting the high temperature and high humidity is taken as $V_0$=1.0 kV, and the environment is judged as the high temperature and high humidity when $V_0$=1.0 kV is satisfied. Then, on the basis of the thus-obtained operation environment, the control similar to that in Second Embodiment is effected.

As described above, according to this embodiment, even in the case where the amount of the developer transferred onto the sheet material is decreased with the operation of the process cartridge, it becomes possible to provide the image forming apparatus in which the lowering in density of the solid image is less liable to occur.

[Fourth Embodiment]

In this embodiment, the target temperature of the fixing device 9 is controlled by focusing attention to the leading edge of the sheet material at which a so-called positive ghost occurring due to the developing device is liable to caused. This positive ghost is a phenomenon caused by the lowering in developing property during first circumferential rotation of the developing sleeve 41 due to charge-up of the developer on the developing sleeve 41 in the pre-rotation of the developing sleeve 41 during non-image formation. When the operation amount of the developing device 4 (or the process cartridge 2) is increased, the positive ghost resulting from the developing device becomes conspicuous in some cases.

This phenomenon is liable to occur at the leading edge of the sheet material. When the developing property is lowered, the amount of the developer transferred onto the leading edge of the sheet material is decreased and therefore the "texture exposure due to fixation" by agglomeration of the developer is also liable to occur. In this embodiment, by lowering the target temperature T0, it is possible to alleviate the degree of the "texture exposure due to fixation" by the agglomeration of the developer at the leading edge of the sheet material.

Specifically, the target temperature of the fixing device 9 at the thresholds W1 to S3 described in First to Third Embodiment was controlled as follows.

W1: T0=200° C./T1=195° C.

W2: T0=185° C./T1=185° C.

W3: T0=170° C./T1=180° C.

In this embodiment, the print-ready target temperature is further decreased at the thresholds W2 and W3 where the toner amount decrease at the leading edge of the sheet material by the developing property lowering in the first circumferential rotation of the developing sleeve, so that it becomes possible to suppress the lowering in solid image density (the texture exposure due to fixation). In this embodiment, T0>T1 is satisfied with respect to the target temperature at the threshold W1. This is for the same reason as that in First Embodiment. That is, this is attributable to a necessary amount of heat is increased compared with that during the image formation since the fixing film is warmed again in some cases from an ambient temperature to the fixing temperature during the pre-rotation. Further, depending on a mounting environment or operation state of the image forming apparatus, the necessary amount of heat is further increased in some instances. For example, in the case of T0≤T1, in the low temperature environment, the amount of heat supplied during the pre-rotation becomes sufficient in some instances. Due to this, improper fixing can occur at a leading edge of the sheet material and therefore the condition: T0>T1 is employed.

Further, in this embodiment, the target temperatures at the thresholds W2 and W3 satisfy T0≤T1. At the thresholds W2 and W3, in addition to the above-described formula, the toner amount is decreased in some cases at the leading edge of the sheet material due to the decrease in developer amount in the first circumferential rotation of the developing sleeve. When the toner amount is small, the necessary amount of heat at the leading edge of the sheet material becomes small and therefore the "texture exposure due to fixation" which is liable to occur at the leading edge of the sheet material is liable to occur. Therefore, the amount of heat at the leading edge of the sheet material was decreased by lowering T0 compared with that at the threshold W1 and thus the degree of the "texture exposure due to fixation" liable to occur at the leading edge of the sheet material was alleviated. Incidentally, at the thresholds W2 and W3, the toner amount at the leading edge of the sheet material is small and therefore such a problem that the amount of heat is insufficient as in the case of the threshold W1 even when T0 is lower than T1 is less liable to occur.

As described above, according to this embodiment, even in the case where the amount of the developer transferred onto the sheet material is decreased with the operation of the process cartridge, it becomes possible to provide the image forming apparatus in which the lowering in density of the solid image is less liable to occur.

Incidentally, in this embodiment, a constitution in which both of the print-ready target temperature T0 (the target temperature before the image formation) and the print target temperature T1 are changed when the temperature of the fixing device 9 is controlled depending on the operation amount of the developing device 40 was described. However, depending on the operation amount of the developing device 40, either one of the print-ready target temperature T0 and the print target temperature T1 may also be changed. Further, not only the target temperature before the image formation but also the target temperature during the image formation may also be controlled.

Incidentally, in the embodiments described above, the constitution in which the image receiving member onto which the toner image on the surface of the photosensitive drum 20 is transferred is used as the example of the sheet material but the present invention is not limited thereto. For example, it is also possible to employ such a constitution that the toner image is primary-transferred from the photosensitive drum 20 onto an intermediary transfer member as the image receiving member and then is secondary-transferred from the intermediary transfer member onto the sheet material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 045534/2010 filed Mar. 2, 2010 and 035797/2011 filed Feb. 22, 2011, which are hereby incorporated by reference.

What is claimed is:

1. An image forming apparatus comprising:

a process cartridge detachably mountable to the image forming apparatus, comprising:

an image bearing member configured to bear a developer image, a developing device, comprising a developer carrying member for forming the developer image on the image bearing member, and a memory medium configured to store an operational history value corresponding to an operation amount of the developing device from an initial operation;

a fixing device configured to fix the developer image on a sheet material, on which the developer image has been transferred, by heating the sheet material; and a controller for controlling a temperature of the fixing device, wherein the controller controls, when the operational history value stored in the memory medium reaches a preset threshold, the temperature of the fixing device so as to be lower than before the operational history value reaches the preset threshold.

2. An image forming apparatus according to claim 1, wherein the operational history value is one of: a number of rotations of the developer carrying member, a number of rotations of the image bearing member, or a remaining developer amount of the developing device.

3. An image forming apparatus according to claim 1, further comprising:

an environment detecting unit configured to detect at least one of a temperature and a humidity in an environment in which the developing device is operated, and wherein the controller is further configured to, when the temperature or the humidity detected by the environment detecting unit is higher than a preset reference value, adjust the operational history value to be larger than that when the temperature or the humidity detected by the environment detecting unit is lower than the preset reference value.

4. An image forming apparatus according to claim 3, further comprising:

a transfer member for transferring the developer image from the image bearing member onto an image receiving member, and wherein the environment detecting unit is configured to detect at least one of the temperature and the humidity in the environment in which the developing device is operated, on the basis of a resistance value obtained by passing a current through the transfer member.

5. An image forming apparatus according to claim 1, wherein the controller is further configured to:

(i) set, before the operational history value reaches the preset threshold, the temperature of the fixing device before image formation so as to be higher than the temperature of the fixing device during the image formation, and (ii) set, once the operational history value reaches the preset threshold, the temperature of the fixing device during the image formation so as to be higher than the temperature of the fixing device before the image formation.

6. An image forming apparatus according to claim 1, wherein the controller is further configured to set: (i) a pre-image formation target temperature for prior to image formation, and (ii) an image formation target temperature for during image formation, wherein when the operational history value stored in the memory medium reaches the preset threshold, the controller is further configured to set the pre-image formation target temperature and the image formation target temperature to be lower than before the operational history value reaches the preset threshold.

7. An image forming apparatus comprising:

a process cartridge detachably mountable to the image forming apparatus, comprising:

an image bearing member configured to bear a developer image, a developing device, comprising a developer carrying member for forming the developer image on the image bearing member, and a memory medium configured to store a number of rotations of the developing carrying member from the beginning of an operation of the developing device;

a fixing device configured to fix the developer image on a sheet material, on which the developer image has been transferred, by heating the sheet material; and a controller for controlling a temperature of the fixing device, wherein the controller controls, when a number of rotations of the developer carrying member stored in the memory medium reaches a threshold, the temperature of the fixing device so as to be lower than before the number of rotations of the developer carrying member reaches the threshold.

8. An image forming apparatus comprising:

a process cartridge detachably mountable to the image forming apparatus, comprising:

an image bearing member configured to bear a developer image, a developing device, comprising a developer carrying member for forming the developer image on the image bearing member, and a memory medium configured to store an operational history value corresponding to an operation amount of the developing device;

a fixing device configured to fix the developer image on a sheet material, on which the developer image has been transferred, by heating the sheet material; and a controller configured to control a temperature of the fixing device, wherein the controller controls, when the operational history value stored in the memory medium reaches a preset threshold, the temperature of the fixing device so as to be lower than that before the operational history value reaches the preset threshold, and wherein the controller controls the temperature of the fixing device so that a region in which a developer is present before fixing but is to be not present after fixing is prevented from being newly formed on the sheet material.

9. An image forming apparatus according to claim 8, wherein the operational history value is one of: a number of rotations of the developer carrying member, a number of rotations of the image bearing member, or a remaining developer amount of the developing device.

10. An image forming apparatus according to claim 8, further comprising:

an environment detecting unit configured to detect at least one of a temperature and a humidity in an environment in which the developing device is operated, and wherein the controller is further configured to, when the temperature or the humidity detected by the environment detecting unit is higher than a preset reference value, adjust the operational history value to be larger than that when the temperature or the humidity detected by the environment detecting unit is lower than the preset reference value.

11. An image forming apparatus according to claim 10, further comprising:

a transfer member for transferring the developer image from the image bearing member onto an image receiving member, and wherein the environment detecting unit is configured to detect at least one of the temperature and the humidity in the environment in which the developing device is operated, on the basis of a resistance value obtained by passing a current through the transfer member.

12. An image forming apparatus according to claim 8, wherein the controller is further configured to:

(i) set, before the operational history value reaches the preset threshold, the temperature of the fixing device before image formation so as to be higher than the temperature of the fixing device during the image formation, and (ii) set, once the operational history value reaches the preset threshold, the temperature of the fixing device during the image formation so as to be higher than the temperature of the fixing device before the image formation.

13. An image forming apparatus comprising:

an image bearing member configured to bear a developer image;

a developing device, comprising a developer carrying member for forming the developer image on the image bearing member;

a fixing device configured to fix the developer image on a sheet material, on which the developer image has been transferred, by heating the sheet material;

a memory medium for storing an operational history value, of the developing device, which varies depending on a state of an operation of the developing device from start of the operation;

an environment detecting unit configured to detect at least one of a temperature and a humidity in an environment in which the developing device is operated; and a controller for controlling a temperature of the fixing device, wherein the controller controls, when the operational history value stored in the memory medium reaches a preset threshold, the temperature of the fixing device so as to be lower than before the operational history value reaches the preset threshold, and wherein the controller is further configured to, when the temperature or the humidity detected by the environment detecting unit is higher than a preset reference value, adjust the operational history value to be larger than that when the temperature or the humidity detected by the environment detecting unit is lower than the preset reference value.

14. An image forming apparatus according to claim 13, wherein the operational history value is one of: a number of rotations of the developer carrying member, a number of rotations of the image bearing member, or a remaining developer amount of the developing device.

15. An image forming apparatus according to claim 13, further comprising:

a transfer member for transferring the developer image from the image bearing member onto an image receiving member, and wherein the environment detecting unit is configured to detect at least one of the temperature and the humidity in the environment in which the developing device is operated, on the basis of a resistance value obtained by passing a current through the transfer member.

16. An image forming apparatus according to claim 13, wherein the controller is further configured to:

(i) set, before the operational history value reaches the preset threshold, the temperature of the fixing device before image formation so as to be higher than the temperature of the fixing device during the image formation, and (ii) set, once the operational history value reaches the preset threshold, the temperature of the fixing device during the image formation so as to be higher than the temperature of the fixing device before the image formation.

* * * * *